US011107359B1

(12) United States Patent
Timar et al.

(10) Patent No.: US 11,107,359 B1
(45) Date of Patent: Aug. 31, 2021

(54) TERMINAL AREA NOISE MANAGEMENT SYSTEM AND METHOD

(71) Applicant: Architecture Technology Corporation, Minneapolis, MN (US)

(72) Inventors: Sebastian Timar, Santa Cruz, CA (US); Douglas Sweet, Saratoga, CA (US); Gregory Carr, Redwood City, CA (US)

(73) Assignee: Architecture Technology Corporation, Minneapolis, MN (US)

( * ) Notice: Subject to any disclaimer, the term of this patent is extended or adjusted under 35 U.S.C. 154(b) by 358 days.

(21) Appl. No.: 15/875,881

(22) Filed: Jan. 19, 2018

(51) Int. Cl.
*G08G 5/00* (2006.01)

(52) U.S. Cl.
CPC ..... *G08G 5/003* (2013.01); *G08G 5/0091* (2013.01); *G08G 5/0095* (2013.01)

(58) Field of Classification Search
CPC .... G08G 5/003; G08G 5/0091; G08G 5/0095; G08G 5/0034; G08G 5/0039; G08G 5/0043; G08G 5/006; G08G 5/0065; G08G 5/0082; G01S 13/91; G01S 13/93; G01S 13/913; G01S 513/913; B65H 2515/82; G01C 21/34; G01C 23/00
USPC ..... 701/120
See application file for complete search history.

(56) References Cited

U.S. PATENT DOCUMENTS

| | | | | |
|---|---|---|---|---|
| 7,889,133 | B2 * | 2/2011 | Smith | G01S 5/0263 342/450 |
| 9,483,052 | B2 * | 11/2016 | McGregor | B64F 1/26 |
| 10,152,894 | B2 * | 12/2018 | Adler | G08G 5/0026 |
| 10,399,689 | B2 * | 9/2019 | Darnell | B64D 31/06 |
| 2009/0157293 | A1 * | 6/2009 | Cornett | G01C 21/3484 701/415 |
| 2016/0093222 | A1 * | 3/2016 | Hale | G08G 5/0021 701/120 |

* cited by examiner

*Primary Examiner* — Nicholas K Wiltey
*Assistant Examiner* — Terry C Buse

(57) ABSTRACT

A terminal area noise management method includes receiving, at a processor, aircraft information for an aircraft operating in a region in proximity to an airport; accessing a plurality of terminal area flight paths available to the aircraft; estimating a plurality of noise profiles for the aircraft, one estimated noise profile for the aircraft for each of the plurality of flight paths; calculating a plurality of cumulative noise fairness measures using each estimated noise profile; calculating a plurality of operational efficiency values for the aircraft, one or more of the calculated operational efficiency values for the aircraft for each of the flight paths; calculating a plurality of cumulative operational fairness measures using each of the calculated operational efficiency values; and selecting a flight path for the aircraft based on maximizing a cumulative noise fairness measure and a cumulative operational fairness measure.

20 Claims, 13 Drawing Sheets

TERMINAL AREA NOISE MANAGEMENT SYSTEM AND METHOD

BACKGROUND

Noise abatement measures have been implemented to reduce the effects of noisy aircraft operations in the U.S. National Airspace (NAS). Some noise abatement measures are directed to aircraft design, such as development of quieter aircraft engines. Other noise abatement measures are directed to aircraft operations, such as flight restrictions based on time of day and aircraft trajectories, such as using particular runways or flight procedures during specified times, or similar methods to limit or isolate noise emissions or distribute noise exposure. Other initiatives intended to improve aircraft operations may affect, positively or negatively, aircraft noise. For example, the Federal Aviation Administration's (FAA) implementation of Performance-Based Navigation (PBN) flight procedures at airports across the U.S. may affect with noise abatement efforts.

Implementation of PBN allegedly has the potential to allow aircraft to fly more precise routes both en route and during approach and departure flight phases. However, some implementations of PBN flight procedures at airports across the U.S. have encountered significant resistance from segments of surrounding communities that are affected by the noise of aircraft flying PBN procedures. Correspondingly, conventional noise abatement efforts, such as using particular runways or flight procedures during specified times, or similar methods to limit or isolate noise emissions or distribute noise exposure, may limit the benefits of flight efficiency, airport throughout, safety, and reduced emissions and noise that could otherwise be realized from PBN procedures.

SUMMARY

A terminal area noise management method includes receiving, at a processor, aircraft information for an aircraft operating in a region in proximity to an airport; accessing a plurality of flight paths available to the aircraft; estimating a plurality of noise profiles for the aircraft, one estimated noise profile for the aircraft for each of the plurality of flight paths; calculating a plurality of cumulative noise fairness measures using each estimated noise profile; calculating a plurality of operational efficiency values for the aircraft, one or more of the calculated operational efficiency values for the aircraft for each of the flight paths; calculating a plurality of cumulative operational fairness measures using each of the calculated operational efficiency values; and selecting a flight path for the aircraft based on maximizing a cumulative noise fairness measure and a cumulative operational fairness measure.

A method for managing effects on populations of noise emitted from aircraft flying in a terminal area, comprising a processor receiving an identity of and information for aircraft expected to fly in the terminal area; the processor receiving a terminal area primary flight path and one or more secondary flight paths for the aircraft; using the information for the aircraft, the processor determining expected emitted noise values for the aircraft and operational efficiency values for the aircraft along each of the primary and the one or more secondary flight paths; and the processor assigning individual aircraft to one of the primary and the one or more secondary flight paths to optimize the emitted noise values and the operational efficiency values.

A terminal area noise management system comprising machine instructions stored in a non-transitory computer readable storage medium, the machine instructions, when executed, causing a processor to receive aircraft information for an aircraft operating in a terminal area for an airport; access a plurality of terminal area flight paths available to the aircraft; estimate a plurality of noise profiles for the aircraft, one estimated noise profile for the aircraft for each of the plurality of terminal area flight paths; calculate a plurality of cumulative noise fairness measures using each estimated noise profile; calculate a plurality of operational efficiency values for the aircraft, one or more calculated operational efficiency values for the aircraft for each of the terminal area flight paths; calculate a plurality of cumulative operational fairness measures using each of the calculated operational efficiency values; and select a terminal area flight path for the aircraft based on maximizing a cumulative noise fairness measure and a cumulative operational fairness measure.

DESCRIPTION OF THE DRAWINGS

The detailed description refers to the following figures in which like numerals refer to like objects, and in which.

DETAILED DESCRIPTION

Figure 1A:
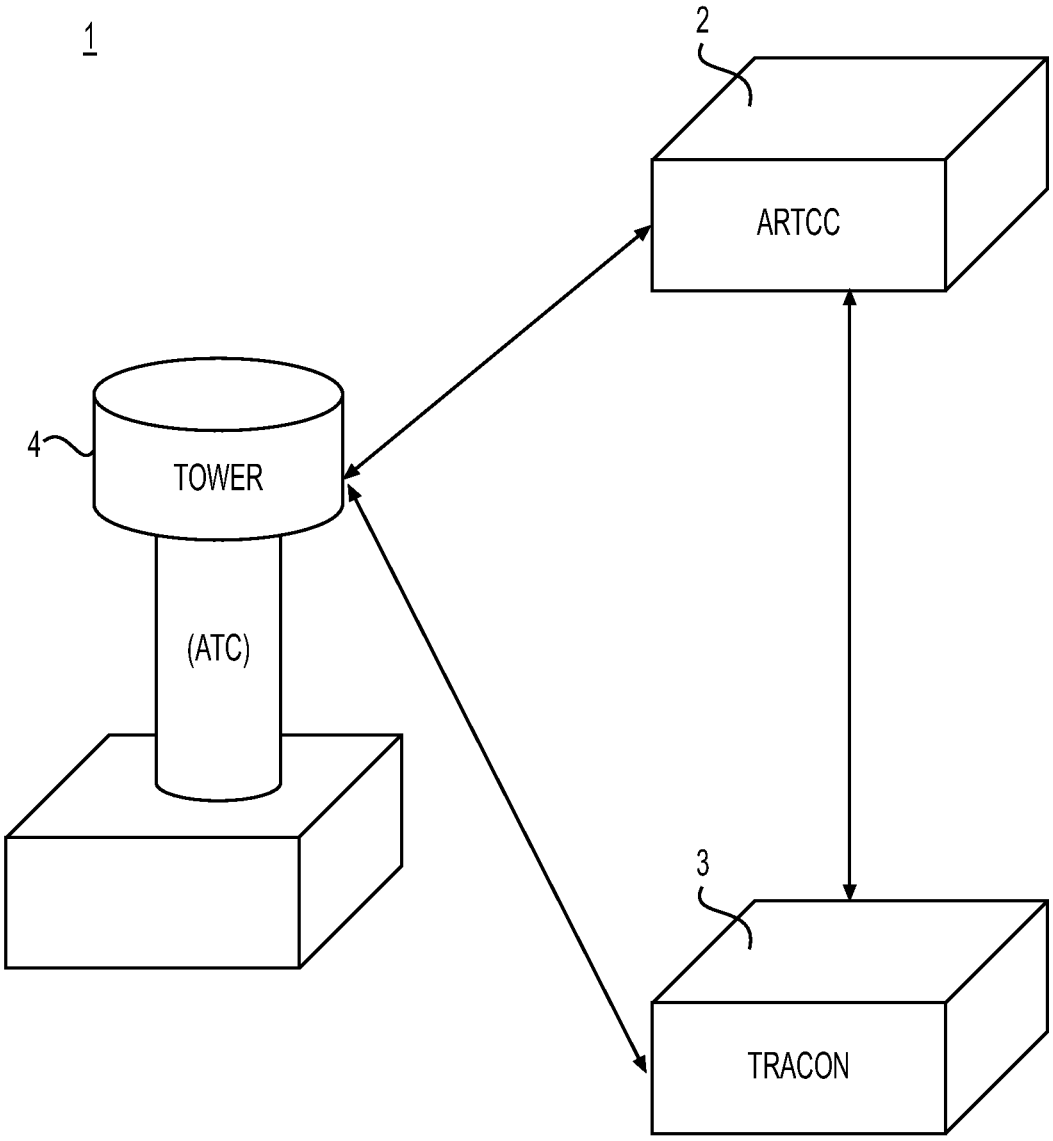
FIGS. 1A and 1B illustrate selected elements of the National Airspace System (NAS) and their functions.

FIG. 1A illustrates selected elements or facilities of the National Airspace System (NAS). In FIG. 1A, NAS 1 is seen to include Air Route Traffic Control Center (ARTCC) 2, Terminal Radar Approach Control (TRACON) 3, and Tower (air traffic control—ATC) 4, all of which cooperate to safely move aircraft from departure point to arrival point. As their names suggest, the ARTCC is an en route facility and the TRACON 3 and Tower 4 are terminal area facilities. These three facilities may employ a number of programs and decision support tools (DST) to manage air traffic in all flight phases. For example, traffic managers at the ARTCC 2 may use a Traffic Flow Management System (TFMS) to dynamically manage demand/capacity imbalances, and a Time Based Flow Management (TBFM) system using time-based metering (TBM) allows traffic managers using time-based metering to: (1) more efficiently control arrival times at destination airports by adjusting departure times at originating airports, (2) adjust departure times for more efficient integration of flights into the en route stream (3) use vectoring, holding, or speed directives to deliver aircraft at a given point at a scheduled times, and (4) share runway demand projections, route assignments, and arrival progress so as to efficiently adjust routes and spacing to manage air traffic flows.

Figure 1B:
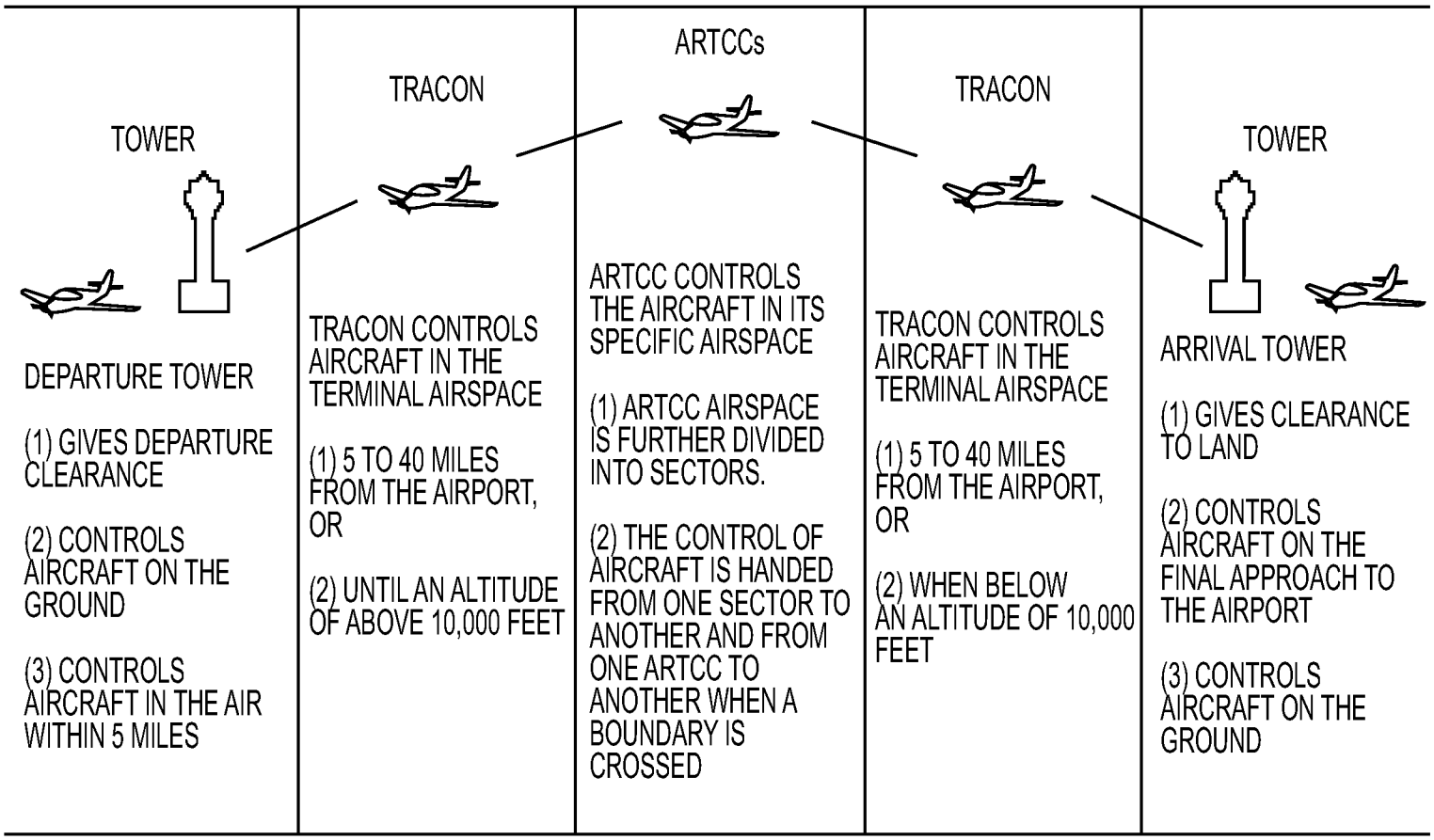

FIG. 1B illustrates selected functions of the facilities shown in FIG. 1A. Generally, the TRACON 3 and Tower 4 control flight operations in an airport's terminal area, including assigning aircraft to specific arrival and departure routes, and the ARTCC manages en route flight operations.

Figure 2A:
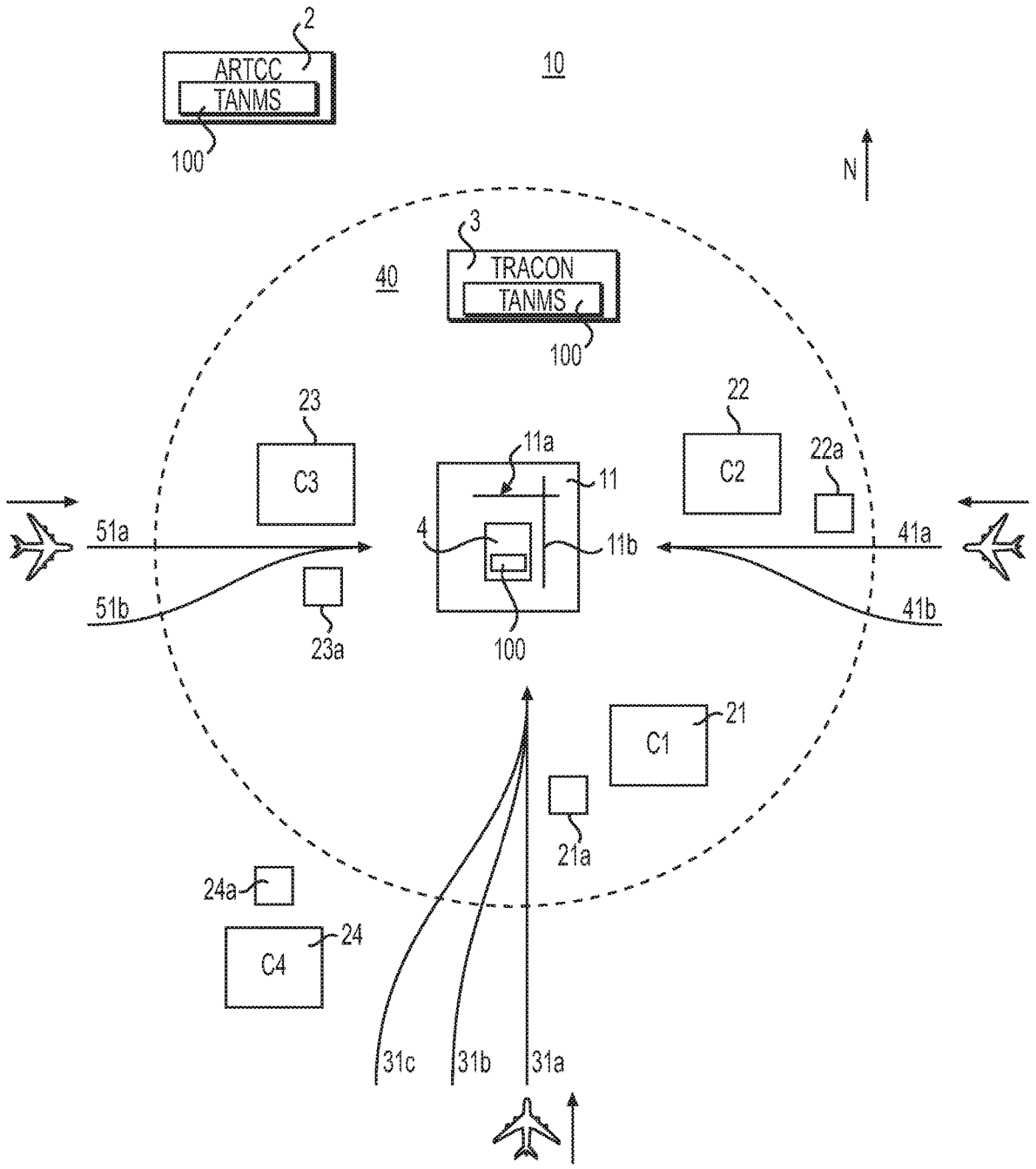
FIGS. 2A-2C illustrate aspects of performance based navigation (PBN) in the NAS.
Figure 2B:
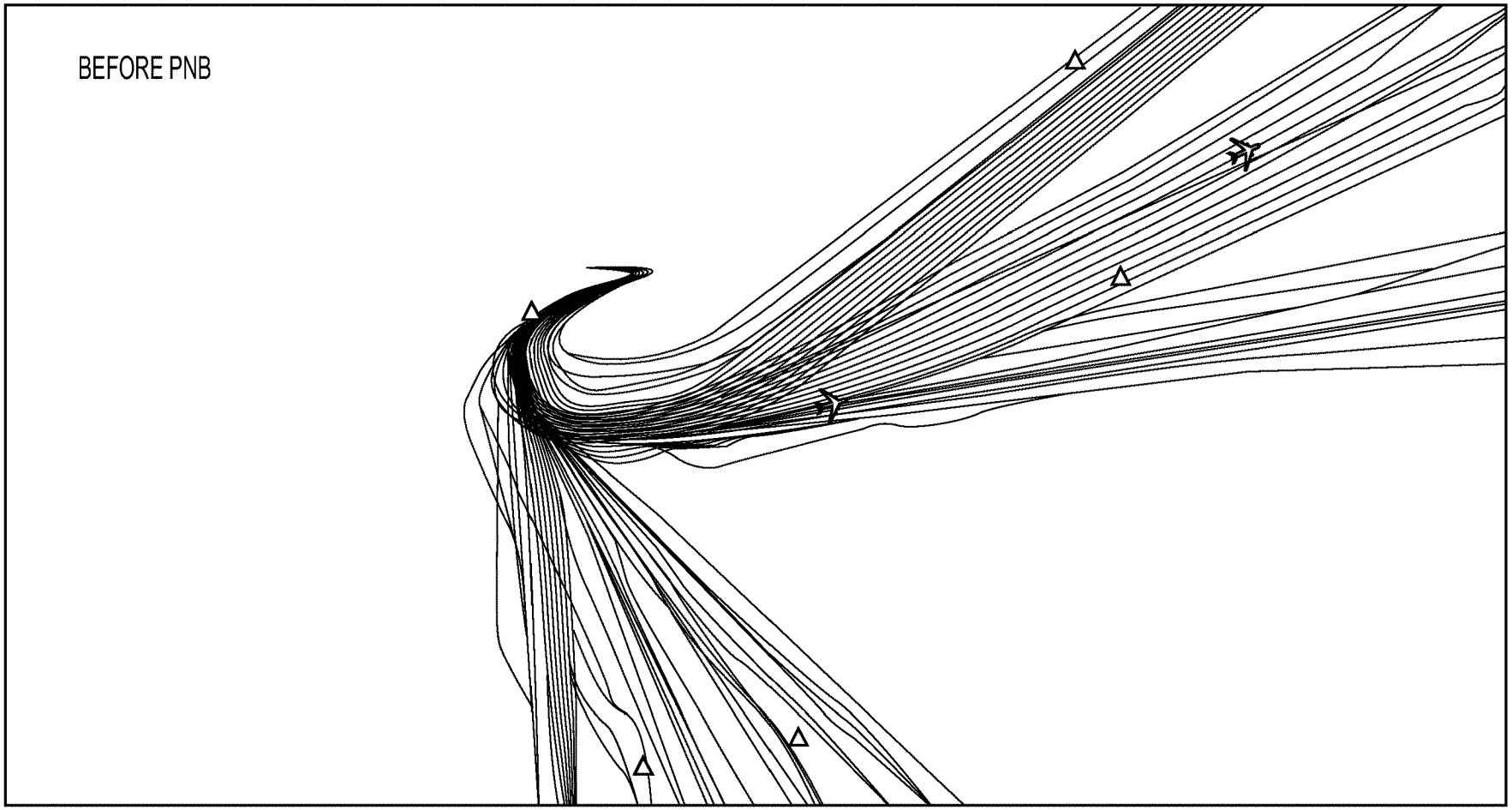
Figure 2C:
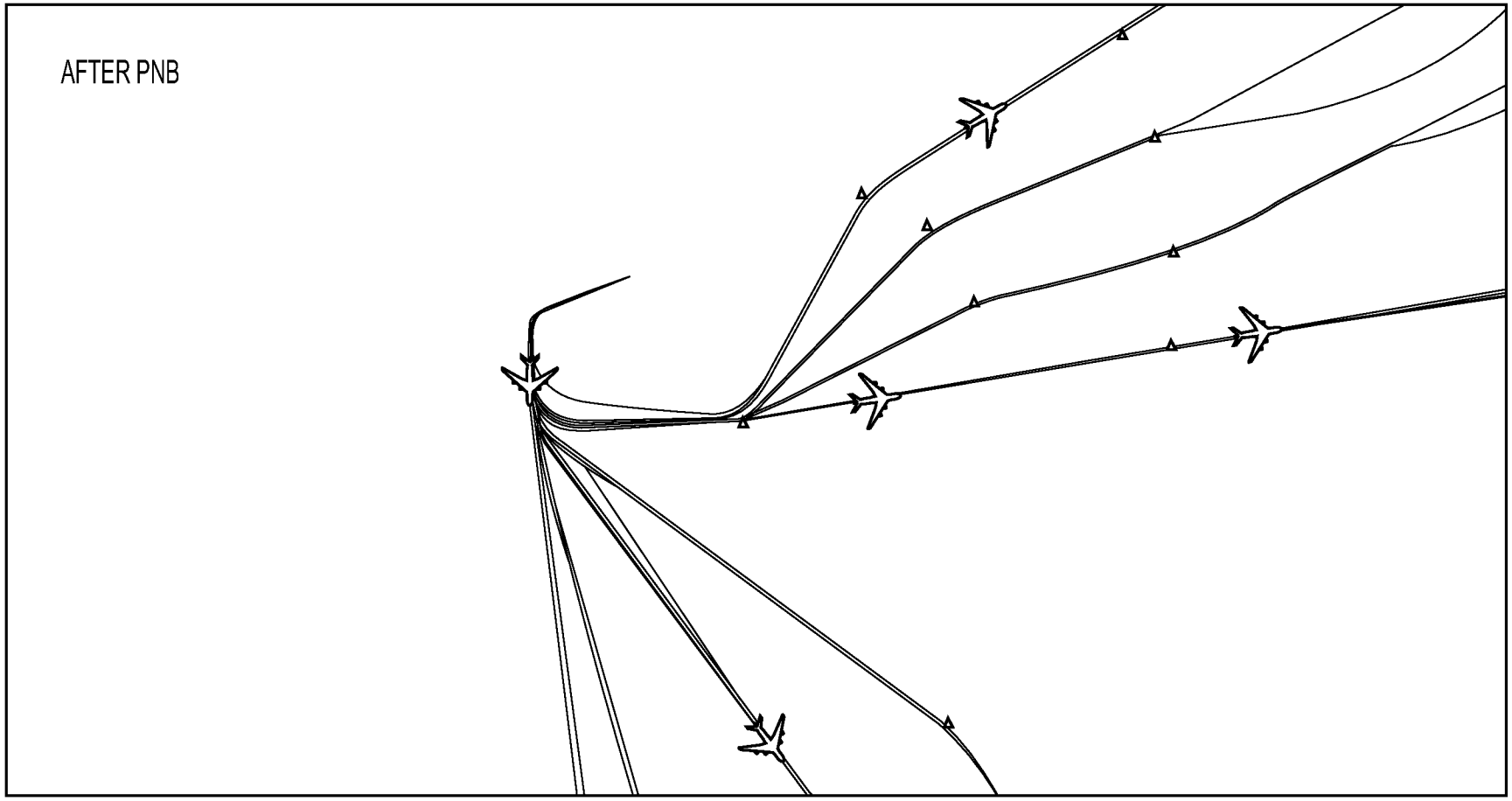

In an effort to improve aircraft efficiency, among other reasons, the Federal Aviation Administration (FAA) in cooperation with Air Navigation Service Providers (ANSPs) began implementing Performance-Based Navigation (PBN) as part of en route, departure, and arrival flight procedures. One aspect of PBN is use of satellite navigation to fly more precise routes. FIGS. 2A-2C illustrate selected aspects of PBN in the NAS 1.

FIG. 2A illustrates an environment 10 in which PBN procedures may be implemented. In FIG. 2A, airport 11 includes tower (ATC) 4. The airport 11 is configured with crossing runways; a first runway 11*b* is oriented south to north and a second runway 11*a* is oriented west to east. Considerations for runway orientations include terrain, population centers, and prevailing winds in the vicinity of the airport. The airport 11 is situated among communities 21-24. As part of its noise reduction program, the airport authority (in cooperation with other entities) may have established a number of noise monitors, examples of which are monitors 21*a*-24*a*. Straight paths from the runways 11*a* and 11*b* are near communities 21-23. To spread noise among the communities 21-24, arriving flights may operate on approaches that deviate from a straight path. For example, flights from the south may take one of three approaches, namely 31*a*, 31*b*, and 31*c*. Typically, approaching aircraft may descend to 10,000 feet at the 40-mile radius (i.e., the terminal airspace 40, shown by the dotted line) from the airport 11, at which point, aircraft noise may be noticeable in the communities 21-24, and detected by the monitors 21*a*-24*a*. The monitors 21*a*-24*a* may provide outputs to a central processing facility (not shown).

FIGS. 2B and 2C illustrate departure flight path alteration at Atlanta's Hartsfield Airport after implementation of aspects of PBN (see https://www.youtube.com/watch?v=KpkmYFJRHIM). As can be seen in FIGS. 2B and 2C, before PBN implementation, departing aircraft would fly on a number of headings that spread over a wide area, with most points of the compass including at least one flight in a given period. After PBN, departing aircraft followed fewer compass headings; i.e., the departing flight paths were more narrowly constrained because of enhanced navigation accuracy.

While FIGS. 2B and 2C might suggest that PBN implementation has the potential to improve flight efficiency and airport capacity, PBN implementations also may result in noise patterns changes, including increased noise concentration for some communities and shifting of aviation noise to communities that previously were not affected. That is, the concentration of aircraft to a narrowly constrained flight path may result in increased apparent noise emissions along that flight path. As a result, some PBN implementations may face significant opposition from local communities and municipalities that feel adversely affected, and the flight efficiency, airport and airspace efficiency and safety benefits that are possible with PBN procedures may not be realized. As an example, after the implementation of new arrival and departure routes at Phoenix Sky Harbor Airport resulted in complaints from the local community about increased aircraft noise, the City of Phoenix filed a lawsuit against the FAA. Similar resistance has come from citizens near other airports that have introduced PBN procedures, including Chicago O'Hare, JFK, and Washington Dulles. The Civil Air Navigation Services Organization (CANSO) and Airports Council International (ACI) (2015) directly address the problems related to PBN implementations and the effects on local communities: Thus, although PBN may improve safety, enhance airport capacity, and reduce the environmental effects (e.g., greenhouse gas emissions) of aircraft through reducing the distance flown, PBN routes may cause some communities to be affected by a change in noise patterns or an increased concentration of noise in certain areas.

One solution to the problems posed by PBN implementations involves actively managing aircraft arrival and departure procedures in a way that can lessen the actual or perceived effects of noise concentration while maintaining the benefits of traffic flow efficiency and reduced fuel and emissions. Two common noise abatement procedures for arrival and departure operations are: (1) the design of new arrival and departure routes, and (2) noise sharing through the alteration of arrival and departure routes. Current noise abatement efforts involving noise sharing are based on pre-planned changes in runway usage or airport configuration (e.g., flying over certain areas on some days and moving flights to other areas on other days) to provide respite periods. Respite periods provide a measure of the number of hours or days per week (or month) when a specific community will not be directly overflown during certain periods. As an example, Air Services Australia implemented a rotating block of airspace to provide a periodic respite to the inhabitants. However, use of narrowly constrained, pre-planned route variation, such as shown in FIG. 2C, may not provide an optimum balance between noise abatement and improved flight efficiency. To improve the balance between the interdependent goals of achieving noise sharing fairness and flight routing (or operational) fairness, disclosed herein is a Terminal Area Noise Management System (TANMS). The TANMS may generally apply to aircraft operating within an airport's terminal area, which typically is a 40-mile radius centered on an airport. See, for example, area 40 of FIG. 2A. However the TANMS also may apply to aircraft operating in proximity to the airport, where proximity to the airport may extend beyond the 40-mile radius. In an embodiment, as used herein, proximity to the airport may extend from zero miles to 80 miles. In another embodiment, proximity to the airport may extend from zero miles to 120 miles. In yet another embodiment, proximity to the airport may extend from zero miles to any radius. Furthermore, proximity to an airport need not be equal in all compass points emanating from the airport. In still another embodiment, the TANMs may apply to aircraft operating in en-route areas. Finally, TANMS may apply to both approaching and departing aircraft.

Figure 3A:
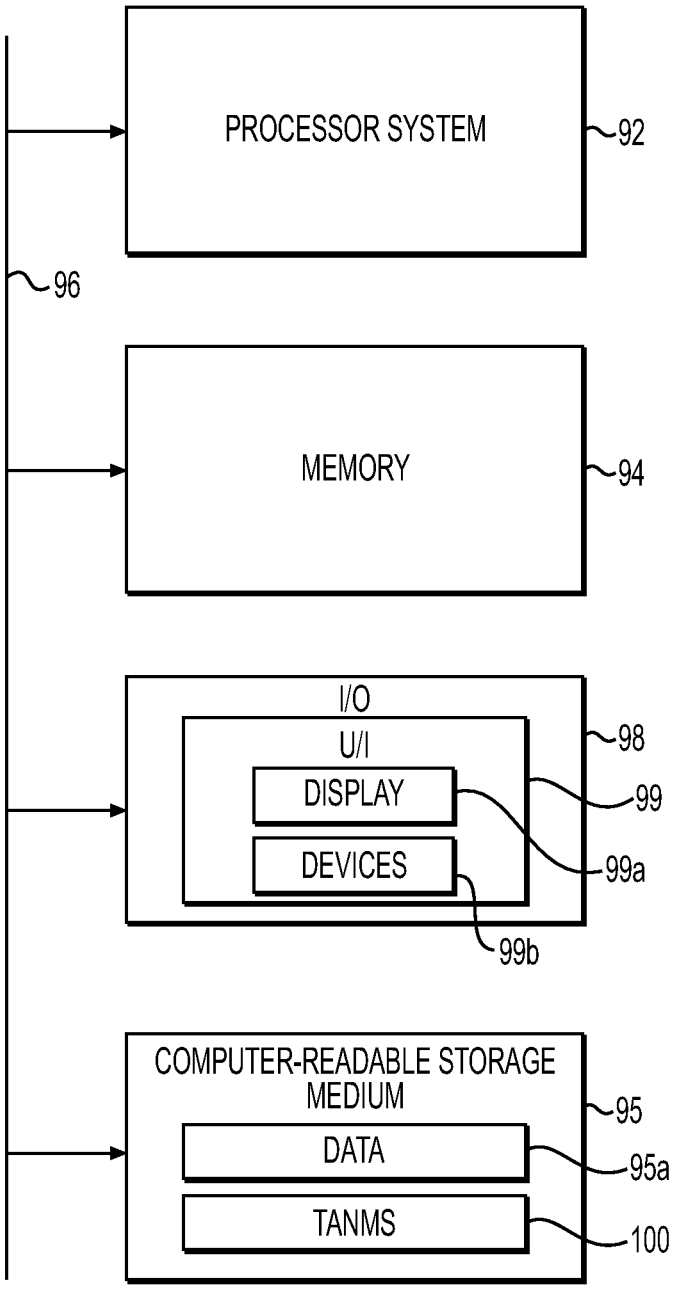
FIGS. 3A and 3B illustrate, respectively, an example computer system, and an example terminal area noise management system (TANMS) implemented on the example computer system.
Figure 3B:
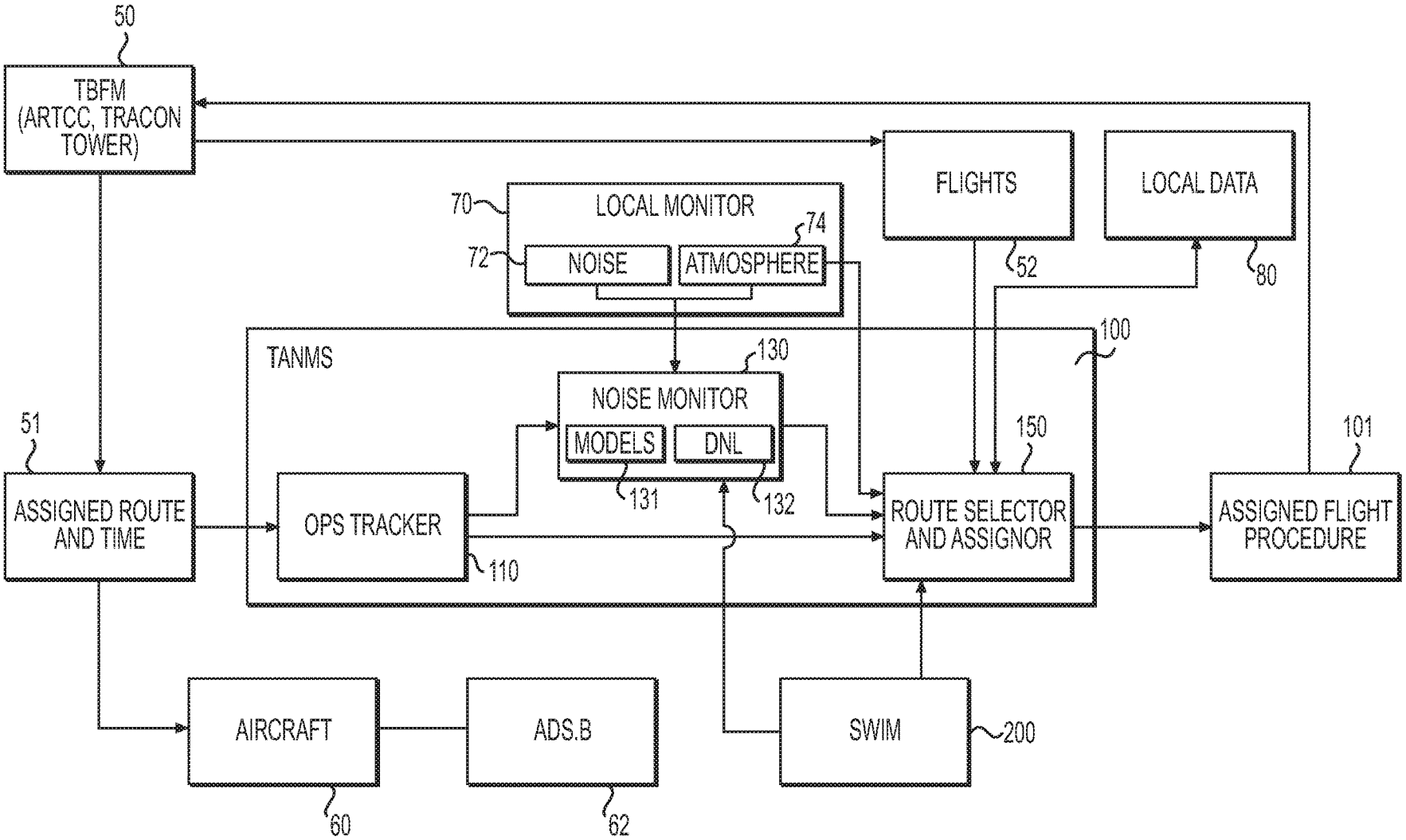

FIGS. 3A and 3B illustrate, respectively, a computer system and a TANMS 100 implemented at either or both of the airport Tower 4 and the TRACON 3 of FIG. 2A. The TANMS also may be implemented at ARTCC 2. In FIG. 3A, computer system includes processor system 92, memory 94, communications bus 96, and input/output (I/O) device 98. The processor system 92 may include one or more physical or virtual processors. The communications bus 96 provides communications among components of the computer system and communications with other computer systems. The input/output device 98 may include a user interface (UI) 99, which in turn may include a display screen 99*a* that presents information to TANMS operators, as well devices 99*b* (such as a mouse, keyboard, or voice command device) to allow TANMS operators to operate the computer system. The computer system further may include non-transient, computer readable storage medium 95 on which may be stored the TANMS 100 and data 95*a* used by or generated by the TANMS 100. In operation, machine instructions of the TANMS 100 are loaded into memory 94 and are executed by processor system 92.

FIG. 3B illustrates the example TANMS 100, which intelligently applies noise abatement procedures of flight path alteration and noise sharing in real time based on ambient conditions, operational constraints, noise constraints and cumulative noise emissions. TANMS 100 may be used in an airport terminal area (see for example, area 40 of FIG. 2A), in proximity to an airport, or in any en-route area. In FIG. 3B, TANMS 100 includes operations (Ops) tracker 110, noise monitor 130, and route selector & assignor 150. The TANMS 100 receives inputs from and provides outputs to Time Based Flow Management system 50, which also may be instantiated at TRACON 3 and Tower 4. For example, for arriving aircraft, the Ops tracker 110 receives assigned route and landing time data 51 generated by the TBFM system 50 and the route selector & assigner 150 receives incoming flight data 52 from the TBFM system 50. For departing aircraft, the TANMS 100 receives similar data from the TBFM system 50. The TANMS 100 also receives information from local monitor system 70, which includes noise monitors 72 and atmospheric (e.g., weather) monitor 74. The noise monitors 72 may include one or more microphones (not shown). The noise monitors 72 may provide noise measurements in decibels for each aircraft. The local monitor system 70 may be operated and maintained by the airport authority; alternately, some components of the local monitor system 70 may be operated by entities other than the local airport authority. The local monitor system 70 may provide noise monitor information in real time (i.e., as collected) or near real time and may provide local atmospheric and local weather information. Alternately, the local monitor system 70 may receive local atmospheric and weather information from a separate entity such as National Oceanographic and Atmospheric Administration (NOAA) or Federal Aviation Administration (FAA) System Wide Information Management (SWIM). The local monitor system 70 may collect information in the terminal area (see, for example, terminal area 40 of FIG. 2A) or in proximity to the airport 11. Finally, the TANMS 100 receives inputs from local data system 80 and optionally from System Wide Information Management (SWIM) 200.

The Ops tracker 110 performs at least three operations. First, the Ops tracker 110 may determine an aircraft's flight parameters and profile given flight information for that aircraft from an ARTCC or TRACON. For example, the Ops tracker 110 may determine expected altitude, speed, and rate of descent for an approaching aircraft and minimum separation for preceding and following flights. Second, the Ops tracker 110 may receive actual position and other aircraft data (from ADS-B, for example) for an aircraft to be used in an actual emitted noise computation. Third, the Ops tracker stores the flight parameters of previous aircraft transiting the noise-sensitive region as information to be used by the Noise Monitor for tracking cumulative noise emissions and by the Route Selector and Assignor for selecting a particular primary or secondary route and assigning it to the aircraft.

The noise monitor 130 generally estimates noise emitted by aircraft flying in the terminal area, or in any area for which noise emission data are desired, such as in proximity to the airport 11, or in other noise-sensitive regions that are, or extend, beyond the terminal area, based on individual aircraft's characteristics and a possible flight path, as well as atmospheric and weather conditions. The noise monitor 130 also generates cumulative noise estimates for all aircraft in a given period. The noise monitor 130 may generate cumulative noise estimates for specific geographic sectors of the terminal area as well as for the entire terminal area. If microphone measurements are not available, or in addition to use of microphone measurements, the noise monitor 130 may use one or models 131 to perform the noise estimation. As an example, the noise monitor 130 may use the FAA's Aviation Environmental Design Tool (AEDT) to estimate noise. In addition, the noise monitor 130 may receive actual noise data from environmental monitors dispersed about the airport and may use the data (1) as part of the noise estimation process, and (2) to determine actual noise impact from a specific flight or sequence of flights. For example, the noise monitor 130 may receive noise emission measurements for each aircraft in decibels from noise monitors 72. Using the noise monitor 130, the TANMS 100 tracks cumulative noise emissions in a period, such as 24 hours, using a standard metric such as DNL as part of a process to assign a flight path to an aircraft. Additionally, the noise monitor 130 may use a Day-Night Sound Level (DNL) process to estimate and assess cumulative noise emissions and their impacts on the geographic sectors.

The route selector & assignor 150 selects flight paths within the terminal area for assignment to a specific aircraft, approaching or departing. The route selector & assignor 150 also may select flight paths for aircraft operating outside the terminal area. The selection process may involve a constrained optimization process that involves at least two variables: one related to noise sharing among communities in the terminal area and another related to equalizing the operational effect of noise sharing on individual airlines or similar entities. For example, noise sharing may be implemented by having certain aircraft fly different routes into and out of an airport. The different paths may be inefficient in that they are longer than a maximally direct path, or may require additional turns or a less efficient ascent or descent. The noise sharing therefore may affect operational efficiency of a particular aircraft and cumulatively, operational efficiency of an airline. The operational efficiency may be based on additional miles flown, additional fuel burn, additional flight time, or any other metric suitable for a particular TANMS implementation. The route selector & assignor 150 includes mechanisms to equalize the burden imposed on airlines in the noise sharing process. The route selector & assignor 150 selects routes for individual aircraft so as to meet any noise sharing scheme developed for the communities in or near the terminal area. The noise sharing scheme may involve constraints. The noise sharing scheme will at least comply with DNL requirements. The route selector & assignor 150 assesses available flight paths to determine a current cumulative value of emitted noise along each flight path and selects a flight path based in part on that determination. Thus, the route selector & assignor 150 dynamically analyzes cumulative noise values and cumulative operational effects of flying alternate routes to select a specific flight path to assign to a specific aircraft.

Figure 4:
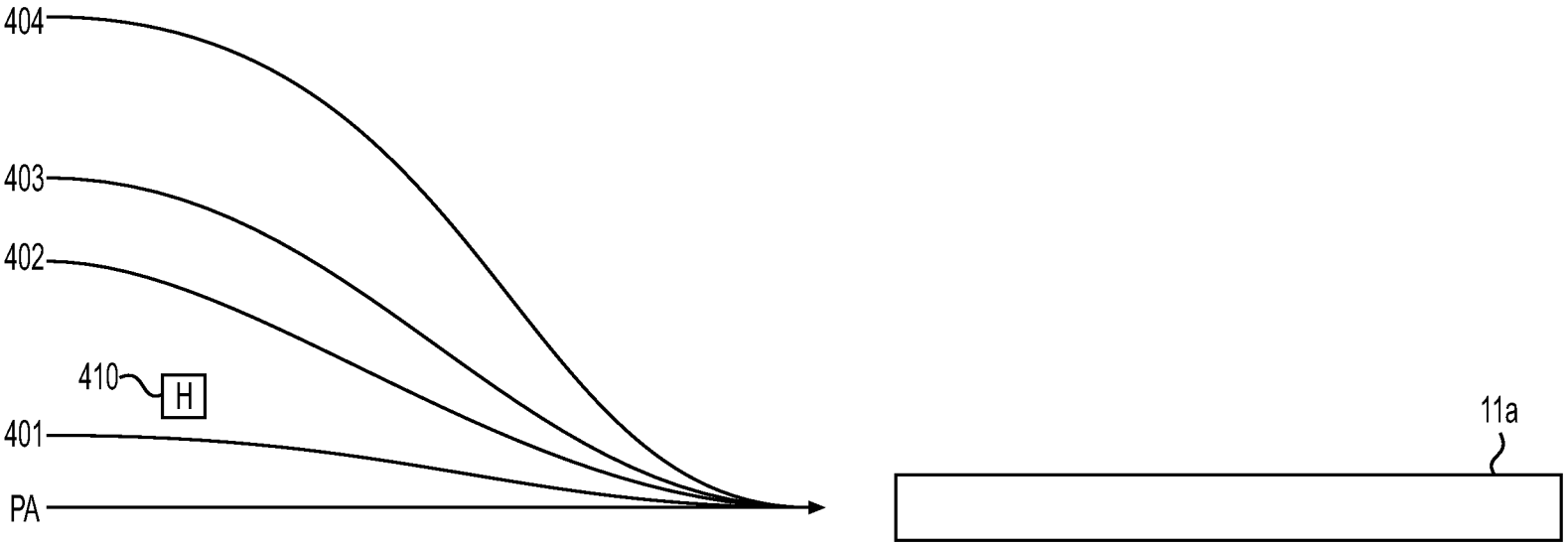
FIG. 4 illustrates a route plan produced by execution of the TANMS of FIG. 3B.

FIG. 4 illustrates one aspect of the TANMS 100, namely developing arrival and departure routes 401-404 that are offset from the primary arrival PA or departure PD (not shown) routes (e.g., one or more routes determined by PBN procedures if implemented, or legacy routes), but still contained within some distance of the primary route PA for runway 11*a*. Rather than simply offsetting the alternate routes 401-404 by a specified amount, the TANMS 100 accounts for specific population concerns, including the proximity of facilities such as hospitals and schools, population density, and other characteristics of the local communities when computing the alternate routes. In the example of FIG. 4, alternate approach route 401 is closest to hospital 410, and route 410 may be designated as a high impact route. In an aspect, to minimize the effects of noise emissions restrictions may be placed on use of route 401 such as only quieter aircraft may fly the route, fewer aircraft may fly the route, and time of day for flights for this route may be limited. In addition, the TANMS 100 may provide an option for inputs from the local community. The TANMS 100 then uses numerous operational metrics, the database of possible arrival and departure routes, and information such as airport weather, runway configuration, and airport loading to suggest to air traffic managers and/or controllers route assignments for aircraft arriving to and departing from the airport 11. The TANMS 100 enables air traffic managers to manage noise exposure intelligently based on factors such as population impact (density), sensitive locations (residential, schools, commercial, business, hospitals, houses of worship), scale of change in noise, time of day, time of year, noise generation and propagation conditions (aircraft, atmospheric), and fairness in noise sharing (so even high impact routes are used some of the time, just not as much as low impact ones) while maximizing airport throughput and flight efficiency (minimizing transit distance, transit time, fuel burn and emissions). In this manner, the TANMS 100 provides tools to manage noise concentrations both temporally and geographically to lessen the impact of noise on the local community while maintaining the operational benefits associated with advanced arrival and departure procedures. The TANMS 100 produces an equitable, demonstrable and defensible distribution of noise exposure among communities near the airport, while maximizing the precision routing benefits of PBN flight procedures for aircraft operators, air traffic controllers, airport operators and aircraft passengers.

In an embodiment, the alternate routes 401-404 may, but need not, conform to alternate routes that would be devised using PBN procedures, or may be legacy navigation routes. The alternate routes 401-404 may be static, pre-defined routes or may be determined dynamically. The alternate routes 401-404 may be stored in the local database 80.

In another embodiment, the TANMS 100 executes to optimize aircraft arrival and departure route or path selection with respect to aircraft noise and aircraft efficiency, with constraints such as a maximum noise value and existing day/night noise level (DNL) requirements. Considering departing aircraft, TANMS 100 contains or accesses a database (e.g., local database 80) of alternate (parallel or diverging) flight paths along a nominal or primary departure route (which may, but need not, conform to the PBN departure route). TANMS 100 assigns these alternate flight paths to departing aircraft based on noise metrics and other factors such as weather, time of day, time of week, and airport loading, to lessen the concentration of noise along the assigned departure route(s). In an aspect of this embodiment, the TANMS 100 may use arrival and departure corridor swapping to enable trading noise emissions allocated for departure corridors to arrivals corridors. Arrivals may be routed through other arrival or departure corridors, and vice versa, as needed to meet DNL noise emissions level of 65 decibels considered acceptable to the local community over the 24-hour day.

In either embodiment, while noise management procedures such as alternate flight paths or noise sharing may require extensive community engagement prior to implementation, the TANMS 100 provides a system and method for intelligently and collaboratively planning, managing, and monitoring aircraft noise in the terminal area or other noise sensitive regions outside the terminal area. The TANMS 100 demonstrably minimizes and equitably distributes noise exposure, to reduce the effect on individual communities and on the public. The TANMS 100 executes to assign alternate flight paths to optimize metrics of interest including airport throughput, miles flown, time of flight, fuel consumption, and emissions in addition to noise concentration and exposure and determining fairness in the application of noise sharing in a terminal area or other region and flight routing among aircraft operators. In an aspect, the fairness determinations (i.e., noise sharing in the community and aircraft routing among aircraft operators) is determined on one or more of a daily, weekly, monthly, and longer period. For example, the TANMS 100 may execute to provide flight routing (or operational) fairness based on a month's worth of flight operations at airport 11. In another aspect, the flight routing fairness determination may be based on flight operations at multiple airports. Flight routing fairness may be determined based on a number of additional miles imposed on an airline's aircraft through execution of the TANMS 100. In this way, mileage difference may operate as an indicator for flight routing fairness. Other variables such as differences in passenger miles or fuel consumption also could be used as an indicator for flight routing fairness. However, mileage difference as a variable has the advantage of being easily measured and does not require input from a third party such as the aircraft's airline. Noise sharing fairness, as noted above, may involve political considerations and may involve community participation. However, once an agreed upon noise sharing scheme is approved, the TANMS 100 may execute in a manner similar to that for flight routing fairness to determine noise sharing fairness.

In an embodiment, the TANMS 100 route selection process may be reduced to a multi-variable constrained optimization process; the two variables being noise sharing fairness and flight routing fairness and the constraints including DNL requirements and minimum separation requirements, for example.

In addition to the herein disclosed real-time arrival and departure aircraft route or path selection, the TANMS 100 also computes or receives actual values for certain metrics such as additional miles flown and actual noise levels as measured during aircraft arrival and departure operations. Such data then may be stored in the TANMS 100 or local database 80 and may be used subsequently in real-time route selection processes.

Returning to FIG. 3B, execution of the TANMS real-time arriving aircraft route selection begins when the TANMS 100 receives information for incoming flights 52 from TBFM 50 at ARTCC 2. For each of the incoming flights, the route selector 150 selects an arrival route from local database 80 based on flight efficiency and noise reduction considerations, and provides an assigned flight procedure 101 to the ARTCC 2. The assigned flight procedure 101 indicates which alternate route the incoming aircraft 60 is to take. The ARTCC 2 then provides the assigned route and a landing time to the aircraft 60 and to the TANMS 100. In an aspect, routes are assigned through execution of the TANMS 100 and without any input or direction from an air traffic controller (ATC). However, the ATC may override or otherwise change the assigned routes. In another aspect, TANMS 100 provides suggested routes that then are confirmed by the ATC.

The noise monitor 130 invokes noise model 131 to provide real-time noise estimates for arriving and departing aircraft based on the aircraft information (e.g., aircraft type, manufacturer, age), atmospheric (weather) information. The noise monitor 130 may receive inputs from local monitor 70 including information from local noise monitors 72 and local weather data 74. In an embodiment, in addition to computing real-time noise estimates, the noise monitor 130 executes to compute actual noise profiles for arriving and departing flights. In an aspect, the noise monitor 130 receives monitored noise outputs from noise monitors 72 and associates the outputs with specific flights. In another aspect, the noise monitor 130 receives outputs from a day/night noise (DNL) level electronic assessment tool 132. The noise monitor 130 may attribute a specific noise profile to an aircraft (such as the aircraft 60) based on the aircraft's projected or actual route as determined by the Ops tracker 110.

The Ops tracker 110 may execute to confirm arriving and departing aircraft fly the assigned (or suggested) arrival or departure paths. In an aspect, the Ops tracker 110 may receive aircraft position data determined during PBN operations. In another aspect, the Ops tracker 110 may receive aircraft data from an ADS-B system 62 installed on aircraft 60. In yet another aspect, the Ops tracker 110 may receive trajectory information (i.e., predicted aircraft heading and speed) for the aircraft 60 from a Trajectory Based Operations system. The Ops tracker 110 may execute to compute miles flown in excess of a primary arrival (PA) route when the aircraft 60 is assigned an alternate arrival route.

In an embodiment, the TANMS 100 maintains an historical record of arrival and departure routes flown, noise levels associated with those flights, and other data, such as ambient temperature, that may affect flight efficiency and aircraft noise propagation. The TANMS 100 may use the historical record to balance fairness among airlines (i.e., flight routing or operational fairness) and noise sharing among local communities. In an aspect, TANMS 100 may adjust assigned (or suggested) arrival and departure paths from airport 11 if and when the historical record indicates an imbalance.

Figure 5A:
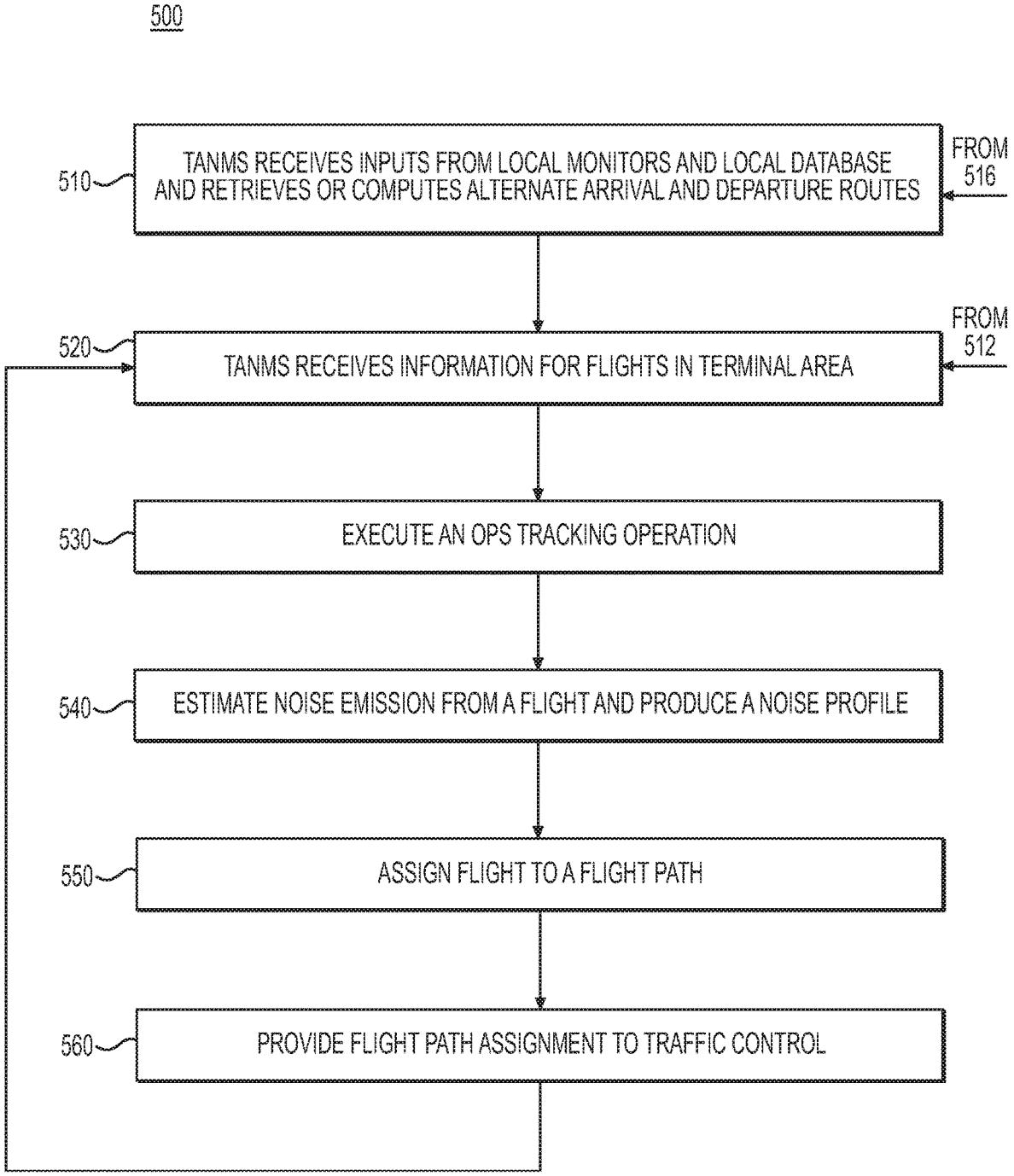
FIGS. 5A-5E are flowcharts illustrating example operations of the TANMS of FIG. 3B.

FIG. 5A is a flowchart illustrating an example operation of the TANMS 100 of FIG. 3B. In FIG. 5A, operation 500 begins in block 510 when the TANMS 100 receives inputs from local monitor 70 and accesses data from local database 80 and executes to either retrieve or compute alternate arrival and departure routes that are offset from their respective primary arrival or departure routes (e.g., one or more routes determined by PBN procedures if implemented), but still contained within a specified distance from the primary routes. Aspects of the process of block 510 are shown in more detail in FIG. 5B.

In block 520, the TANMS 100 receives data from time based flow management (TBFM) system 50 including expected arriving and departing flight information. The TANMS 100 stores the received data in the local database 80. Optionally, the TANMS 100 may perform various operations on the received data prior to storage including parsing the data by one or more pre-defined criteria and verifying the integrity of the data.

In block 530, the TANMS 100 executes an operations tracking operation. The process of block 530 is shown in more detail in FIG. 5C.

In block 540, the TANMS 100 estimates noise for a flight path. In an embodiment, the TANMS 100 produces an estimated noise profile for an aircraft using noise model 131 and information related to the aircraft. The process of block 540 is shown in more detail in FIG. 5D.

In block 550, the TANMS 100 assigns a flight to a flight path to comply with noise criteria and flight routing or operational fairness. The process of block 550 is shown in more detail in FIG. 5E In block 560, the TANMS 100 provides the flight path assignment to TBFM system 50. In turn, the TBFM provides the flight path assignment to aircraft 60. Following block 560, the operation 500 returns to block 520.

Figure 5B:
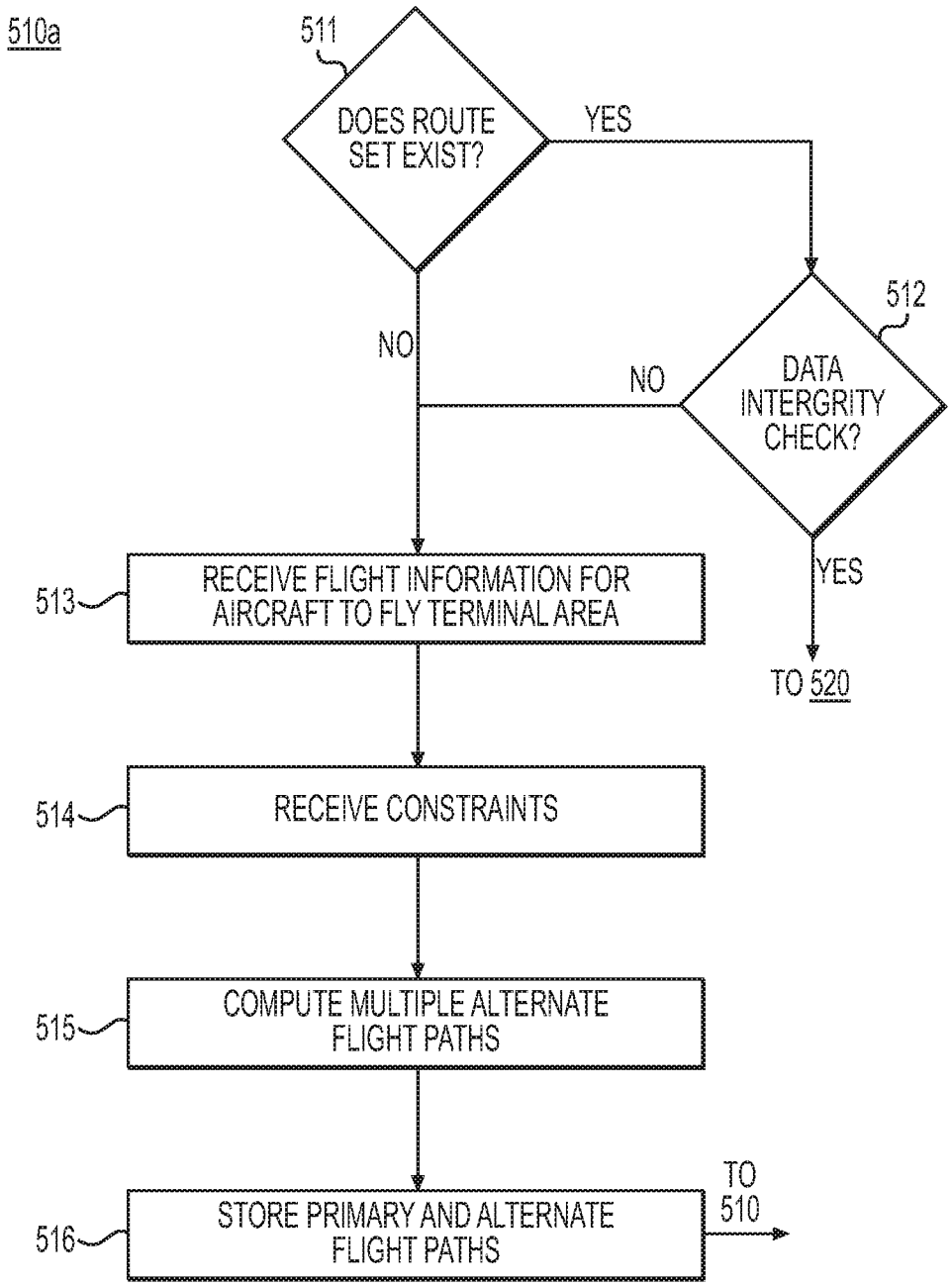

FIG. 5B illustrates example operations of block 510 of FIG. 5A. In FIG. 5B, operation 510*a* begins in block 511 when the TANMS 100 determines if a set of primary and alternate routes exist for a runway of interest (or for each of the runways 11*a* and 11*b*). In block 511, if at least a set of primary and alternate routes exist, the operation 510*a* moves to block 512. In block 512, the TANMS 100 performs an integrity check of the data and a check that the data are up to date. If the data are up to date, the operation 510*a* moves to block 520. Otherwise, the operation 510*a* moves to block 513. In block 513, the TANMS 100 receives route information for all primary approach and departure paths (see FIG. 2A) from the runways 11*a* and 11*b*. The route information may indicate heading, rate of ascent/descent, and speed ranges. In block 514, the TANMS 100 receives any applicable constraint information that would affect formulation of an alternate route. For example, an alternate route may not be possible because of obstructions or terrain. In block 515, the TANMS 100 computes multiple alternate approach and departure paths, specifies weather conditions (e.g., wind speed and direction) that would make an alternate path untenable, rate and type of descent/ascent, and other factors that may affect aircraft operations. In block 516, the TANMS 80 stores the primary and alternate flight path data in the local database 80. The operation 510*a* then returns to block 510.

Figure 5C:
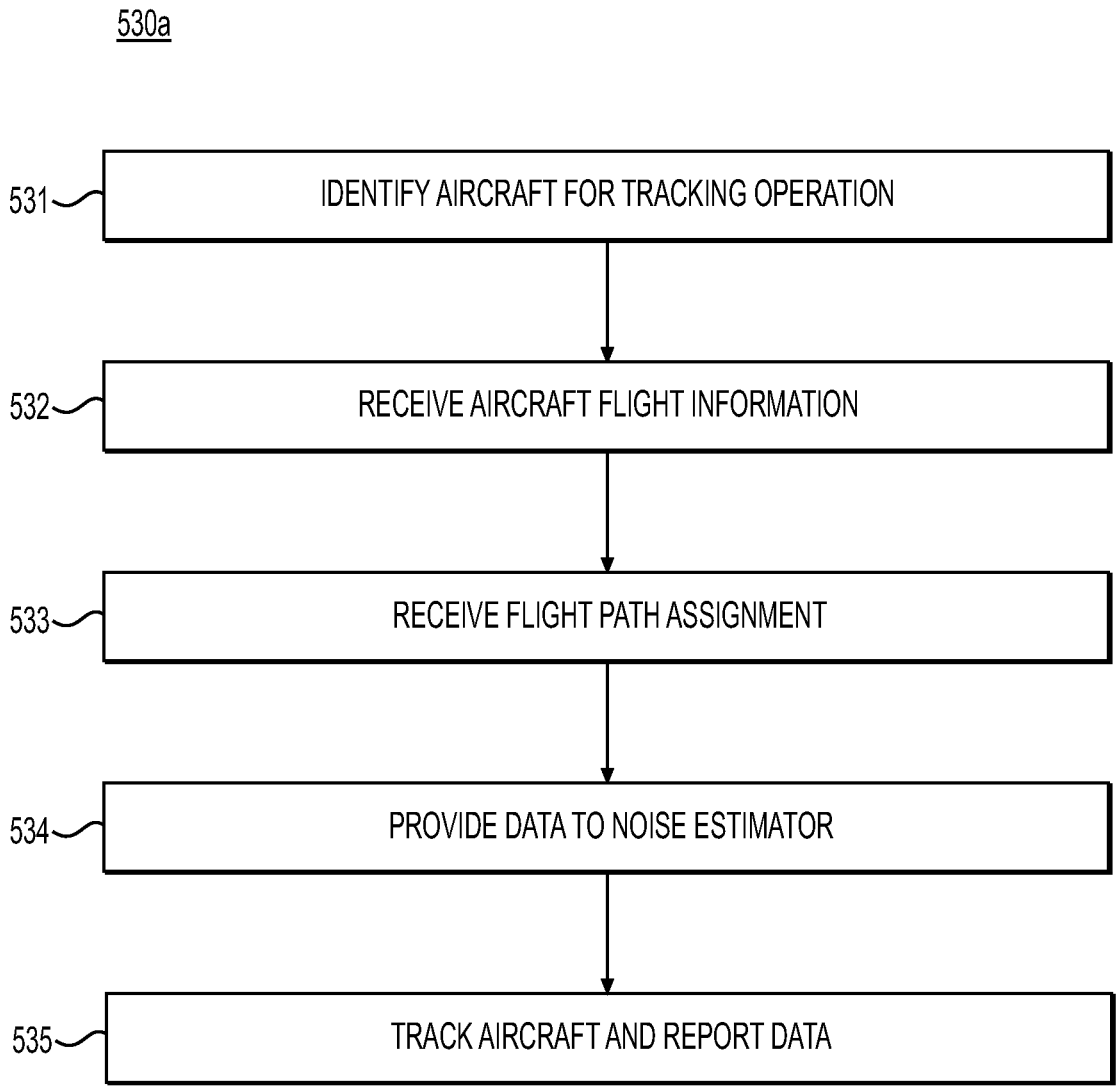

FIG. 5C illustrates example operations of block 530 of FIG. 5A. In FIG. 5C, ops tracking operation 530*a* begins in block 531 when the TANMS 100 identifies aircraft 60 for tracking operations (in this example, aircraft 60 is arriving). In block 532, the TANMS 100 receives aircraft 60 flight information such as position, heading, speed, and altitude, and aircraft data such as call sign, airline, and aircraft model. In block 533, the TANMS 100 receives a flight path (primary or alternate, and runway) for aircraft 60. In block 534, the TANMS 100 provides these data to the noise monitor 130. In block 535, the TANMS 100 tracks the aircraft 60 until landing so that an actual path flown may be determined. The operation 530*a* then ends.

Figure 5D:
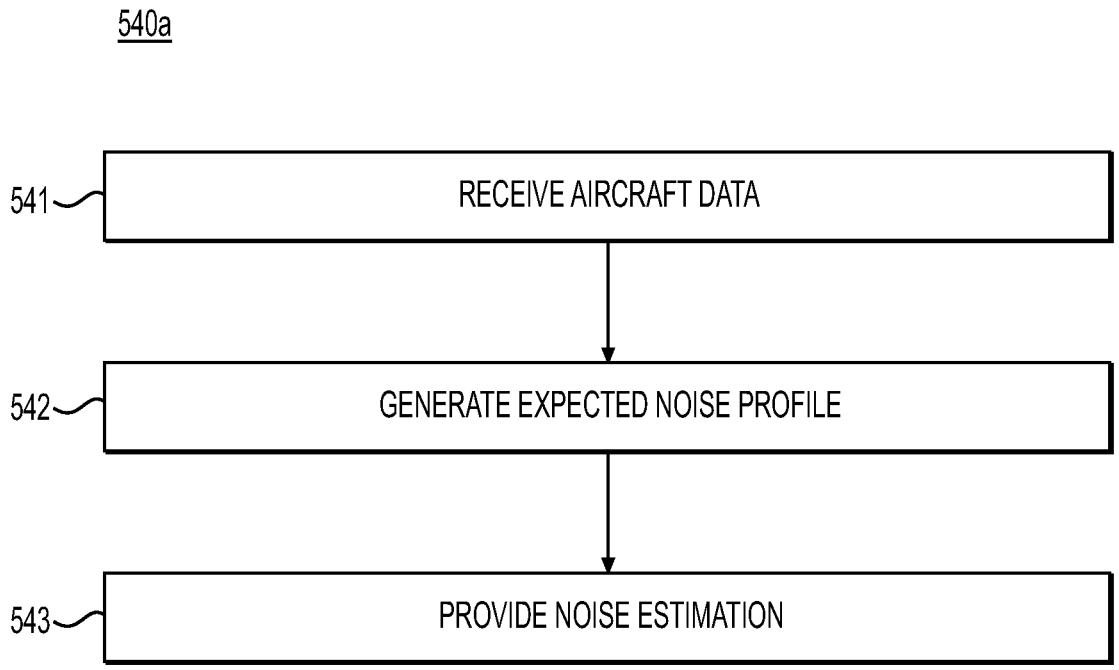

FIG. 5D illustrates example noise estimation operations of block 540 of FIG. 5A. In FIG. 5D, operation 540*a* begins in block 541 when the noise monitor 130 receives aircraft data from execution of operation 530*a*. In block 542, the noise monitor 130 generates an expected noise profile based on the aircraft's type/model, assigned flight path and flight procedure, local weather, and other factors. In block 543, the noise monitor 130 provides the noise estimation to the route selector & assignor 150.

Figure 5E:
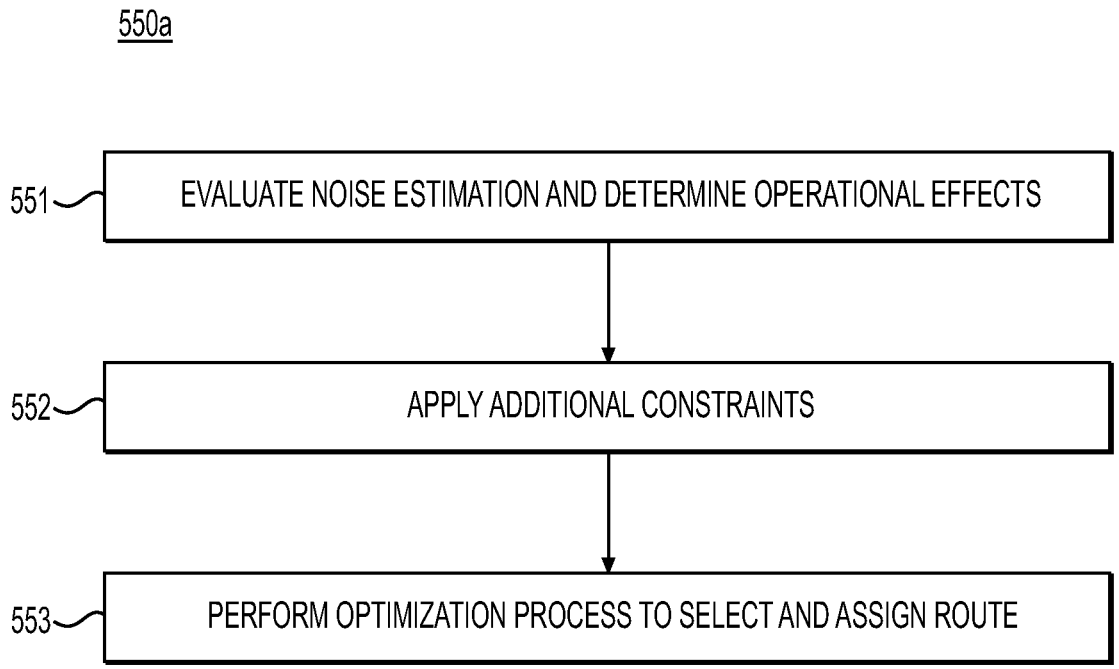

FIG. 5E illustrates example operations of block 550 of FIG. 5A to assign an aircraft to a flight path to comply with noise criteria and flight routing or operational fairness. In FIG. 5E, operation 550*a* begins in block 551 when selector & the assignor 150 evaluates the noise estimation provided by the noise monitor 130 in view of a number of pre-defined noise criteria including DNL values for each of the primary and the alternate flight paths and current cumulative noise values for each of the primary and the alternate flight paths, and determines a number of extra miles flown for each of the alternate flight paths. In block 552, the selector & assignor 150 applies any additional constraints. In block 553, the selector & assignor applies a multi-variable optimization process to select or confirm selection of a flight path that maximizes fairness of noise sharing and fairness of aircraft flight routing. The operation 550*a* then ends.

Certain of the devices shown in the Figures include a computing system. The computing system includes a processor (CPU) and a system bus that couples various system components including a system memory such as read only memory (ROM) and random access memory (RAM), to the processor. Other system memory may be available for use as well. The computing system may include more than one processor or a group or cluster of computing system networked together to provide greater processing capability. The system bus may be any of several types of bus structures including a memory bus or memory controller, a peripheral bus, and a local bus using any of a variety of bus architectures. A basic input/output (BIOS) stored in the ROM or the like, may provide basic routines that help to transfer information between elements within the computing system, such as during start-up. The computing system further includes data stores, which maintain a database according to known database management systems. The data stores may be embodied in many forms, such as a hard disk drive, a magnetic disk drive, an optical disk drive, tape drive, or another type of computer readable media which can store data that are accessible by the processor, such as magnetic cassettes, flash memory cards, digital versatile disks, cartridges, random access memories (RAM) and, read only memory (ROM). The data stores may be connected to the system bus by a drive interface. The data stores provide nonvolatile storage of computer readable instructions, data structures, program modules and other data for the computing system.

To enable human (and in some instances, machine) user interaction, the computing system may include an input device, such as a microphone for speech and audio, a touch sensitive screen for gesture or graphical input, keyboard, mouse, motion input, and so forth. An output device can include one or more of a number of output mechanisms. In some instances, multimodal systems enable a user to provide multiple types of input to communicate with the computing system. A communications interface generally enables the computing device system to communicate with one or more other computing devices using various communication and network protocols.

The preceding disclosure refers to a flowcharts and accompanying descriptions to illustrate the embodiments represented in FIGS. 5A-5E. The disclosed devices, components, and systems contemplate using or implementing any suitable technique for performing the steps illustrated. Thus, FIGS. 5A-5E are for illustration purposes only and the described or similar steps may be performed at any appropriate time, including concurrently, individually, or in combination. In addition, many of the steps in the flow chart may take place simultaneously and/or in different orders than as shown and described. Moreover, the disclosed systems may use processes and methods with additional, fewer, and/or different steps.

Embodiments disclosed herein can be implemented in digital electronic circuitry, or in computer software, firmware, or hardware, including the herein disclosed structures and their equivalents. Some embodiments can be implemented as one or more computer programs, i.e., one or more modules of computer program instructions, encoded on computer storage medium for execution by one or more processors. A computer storage medium can be, or can be included in, a computer-readable storage device, a computer-readable storage substrate, or a random or serial access memory. The computer storage medium can also be, or can be included in, one or more separate physical components or media such as multiple CDs, disks, or other storage devices. The computer readable storage medium does not include a transitory signal.

The herein disclosed methods can be implemented as operations performed by a processor on data stored on one or more computer-readable storage devices or received from other sources.

A computer program (also known as a program, module, engine, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

We claim:

1. A terminal area noise management method, comprising:

receiving, at a processor, airplane information for each of a plurality of airplanes, from each of a plurality of airlines, operating in a terminal area of a region in proximity to an airport;

accessing, by the processor, a plurality of flight paths available to each of the plurality of airplanes;

estimating, by the processor, a plurality of airplane noise profiles, one estimated noise profile for each of the plurality of airplanes for each of the plurality of flight paths;

receiving, by the processor, a noise sharing scheme for the region in proximity to the airport;

calculating, by the processor, a plurality of airplane operational efficiency values, one or more of the calculated airplane operational efficiency values for each of the plurality of airplanes of each of the plurality of airlines for each of the plurality of flight paths;

computing, by the processor, a burden imposed on each of the plurality of airlines using the calculated plurality of operational efficiency values; and assigning a flight path for each of the one or more airplanes for each of the airlines based on the noise sharing scheme and a cumulative operational burden imposed so as to equalize the cumulative operational burden of noise sharing imposed on each of the plurality of airlines resulting from the assigned flight paths for each of the plurality of airplanes.

2. The terminal area noise management method of claim 1, further comprising the processor calculating one or more of the flight paths.

3. The terminal area noise management method of claim 2, wherein one of the plurality of flight paths is a first performance-based navigation (PBN) flight path or a first legacy flight path.

4. The terminal area noise management method of claim 3, wherein each of the plurality of operational efficiency values is a number of miles to fly different from miles to fly for the first PBN or the first legacy navigation flight path.

5. The terminal area noise management method of claim 1, further comprising the processor constraining the assignment of the flight paths based on day/night noise level (DNL) requirements.

6. The terminal area noise management method of claim 1, wherein the processor assesses compliance with the noise sharing scheme by:

accessing noise level data from noise monitors in the region in proximity to the airport; and accessing atmospheric data for the region in proximity to the airport.

7. The terminal area noise management method of claim 1, further comprising:

monitoring, by the processor, adherence by each airplane to its assigned flight path;

receiving radiated noise from the airplane flying its assigned flight path;

generating an actual cumulative noise measure for each of the plurality of airlines using received radiated noise from each of the airline's plurality of airplanes; and storing the actual cumulative noise measure.

8. The terminal area noise management method of claim 1, wherein an airplane is in an approach in the airport.

9. The terminal area noise management method of claim 1, wherein an airplane is in a takeoff from the airport.

10. A terminal area noise management system comprising machine instructions stored in a non-transitory computer readable storage medium, the machine instructions, when executed, causing a processor to:

receive airplane information from a plurality of airlines, each airline having one or more airplanes operating in a terminal area of an airport;

access a plurality of terminal area flight paths available to the each of the one or more airplanes for each of the plurality of airlines;

estimate a plurality of airplane noise profiles, one estimated noise profile for each of the one or more airplanes for each of the plurality of airlines for each of the plurality of terminal area flight paths;

receive a noise sharing scheme for a region in proximity to the terminal area;

calculate a plurality of airplane operational efficiency values, one or more of the calculated airplane operational efficiency values for each of the one or more airplanes for each of the plurality of airlines for each of the plurality of terminal area flight paths;

calculate a plurality of cumulative operational measures using each of the calculated operational efficiency values for each of the plurality of airlines; and select a terminal area flight path for each of the plurality of airplanes based on the cumulative operational measures and the noise sharing scheme.

11. The terminal area noise management system of claim 10, wherein the processor calculates one or more of the terminal area flight paths.

12. The terminal area noise management system of claim 11, wherein one of the plurality of terminal area flight paths is a performance-based navigation (PBN) flight path.

13. The terminal area noise management system of claim 12, wherein each of the plurality of operational efficiency values is a number of miles to fly different from miles to fly for the PBN flight path.

14. The terminal area noise management system of claim 13, wherein each of the plurality of operational efficiency values is fuel consumption different from fuel consumption for the PBN flight path.

15. The terminal area noise management system of claim 10, further comprising the processor constraining selection of the terminal area flight path based on day/night noise level (DNL) requirements.

16. The terminal area noise management system of claim 10, wherein the processor assesses compliance with the noise sharing scheme, comprising the processor:

accessing noise level data from noise monitors servicing the terminal area of the airport; and accessing local atmospheric data for the airport.

17. The terminal area noise management system of claim 10, wherein the processor executes the machine instructions to:

monitor each of the one or more airplanes, of the plurality of airlines, for adherence to each of the one or more airplane's selected terminal area flight path;

receive radiated noise from each of the one or more airplanes, of the plurality of airlines, flying the airplane's selected terminal area flight path;

use the received radiated noise from each of the one or more airplanes to generate an actual cumulative noise measure; and store the actual cumulative noise measure.

18. A method for managing effects on populations of noise emitted from a plurality of airplanes flying in a terminal area of an airport, each of the plurality of airplanes belonging to one of a plurality of airlines, the method, comprising:

a processor receiving an identity of and information from for each of the plurality of airplanes, from each of the plurality of airlines, expected to fly in the terminal area;

the processor receiving a terminal area primary flight path and one or more terminal area secondary flight paths for each of the plurality of airplanes from each of the plurality of airlines;

using the information for each of the plurality of airplanes from each of the plurality of airlines, the processor determining expected emitted noise values and operational efficiency values for each of the plurality of airplanes from each of the plurality of airlines along each of the terminal area primary and the one or more terminal area secondary flight paths; and equalizing an operational burden on each of the plurality of airlines by the processor assigning individual airplanes to one of the terminal area primary and the one or more terminal area secondary flight paths to share operational efficiency values among the plurality of airlines.

19. The method of claim 18, wherein the information from the plurality of airlines comprises individual airplane projected noise emissions and projected operating times and days for each of the plurality of airplanes flying in the terminal area.

20. The method of claim 18, wherein the operational efficiency values are mileage differences between the primary and secondary terminal area flight paths.

* * * * *